US009289994B2

(12) United States Patent
Koide et al.

(10) Patent No.: US 9,289,994 B2
(45) Date of Patent: Mar. 22, 2016

(54) INK JET HEAD AND INK JET PRINTER

(71) Applicant: Brother Kogyo Kabushiki Kaisha, Nagoya-shi, Aichi-Ken (JP)

(72) Inventors: Shohei Koide, Nagoya (JP); Atsushi Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/554,129

(22) Filed: Nov. 26, 2014

(65) Prior Publication Data

US 2015/0158294 A1 Jun. 11, 2015

(30) Foreign Application Priority Data

Dec. 6, 2013 (JP) ..... 2013-252750

(51) Int. Cl.
*B41J 29/38* (2006.01)
*B41J 2/15* (2006.01)
*B41J 2/14* (2006.01)

(52) U.S. Cl.
CPC ..... *B41J 2/15* (2013.01); *B41J 2/14233* (2013.01); *B41J 2002/14266* (2013.01); *B41J 2002/14459* (2013.01)

(58) Field of Classification Search
USPC ..... 347/5, 9, 12, 42, 13
See application file for complete search history.

(56) References Cited

U.S. PATENT DOCUMENTS

2010/0328384 A1* 12/2010 Kyoshima et al. ..... 347/12

FOREIGN PATENT DOCUMENTS

| | | |
|---|---|---|
| EP | 0955174 | 11/1999 |
| JP | H11-320926 | 11/1999 |

* cited by examiner

*Primary Examiner* — Lam Nguyen
(74) *Attorney, Agent, or Firm* — Frommer Lawrence & Haug LLP

(57) ABSTRACT

A channel-structure has first to third nozzle-rows for first-ink, and first and second nozzle-rows for second-ink. Between the first nozzle-row for the first-ink and the first nozzle-row for the second-ink, and between the second nozzle-row for the first-ink and the second nozzle-row for the second-ink, each nozzle is located in the same position. The third nozzle-row for the first-ink is located in a different position with respect to the first and second nozzle-rows. Either the first and the second nozzle-rows for the second-ink are arranged between the first and second nozzle-rows for the first-ink, or the first and second nozzle-rows for the first-ink are arranged between the first and second nozzle-rows for the second-ink. A distance between the first nozzle-row for the first-ink and the first nozzle-row for the second-ink is equal to a distance between the second nozzle-row for the first-ink and the second nozzle-row for the second-ink.

8 Claims, 8 Drawing Sheets

INK JET HEAD AND INK JET PRINTER

CROSS REFERENCE TO RELATED APPLICATION

The present application claims priority from Japanese Patent Application No. 2013-252750, filed on Dec. 6, 2013, the disclosure of which is incorporated herein by reference in its entirety.

BACKGROUND

1. Field of the Invention

The present invention relates to an ink jet head and an ink jet printer.

2. Description of the Related Art

Conventionally, there are known ink jet printers using such a method as to move an ink jet head having a plurality of nozzles in a predetermined scanning direction while jetting an ink or inks from the plurality of nozzles toward a recording medium to print images and the like. Further, as a printing operation of the ink jet printers using this method, there is known a bidirectional print, that is, the ink is jetted to print the images and the like respectively on both occasions that the ink jet head moves in one orientation of the scanning direction and moves in the other orientation of the scanning direction. Further, throughout the present specification, when such a bidirectional print is carried out, the term "forward moving" is used to refer to the moving of the ink jet head in one predetermined orientation, whereas the term "backward moving" is used to refer to the moving of the ink jet head in the opposite orientation from that in the forward moving.

In the bidirectional print mentioned above, the ink jet head jets the ink in both the forward moving and the backward moving. Therefore, there is an advantage for obtaining high print speed. However, when the ink jet head is a color ink jet head or the like configured to jet a plurality of types of inks, then the order of jetting the plurality of types of inks (the ink landing order) differs between the forward moving and the backward moving, thereby resulting in a decrease in image quality. In this regard, in order to equalize the order of jetting the plurality of types of inks between the forward moving and the backward moving, there are conventionally known ink jet heads having such a configuration as to arrange a plurality of types of nozzle rows separately on the left and on the right to respectively jet the plurality of types of inks.

For example, there are known ink jet heads which jet four color inks of black (K), cyan (C), magenta (M), and yellow (Y), and which have two nozzle rows for one color ink. Further, regarding the two nozzle rows for each color, the position of each nozzle of one of the two nozzle rows in the nozzle row direction is shifted with respect to the position of one of nozzle of the other of the two nozzle rows. Further, regarding the nozzle row direction, the position of each nozzle of one of the two nozzle rows for one color is coincide with the position of each nozzle of one of the two nozzle rows for another color. Further, regarding the nozzle row direction, the position of each nozzle of the other of the two nozzle rows for one color is coincide with the position of each nozzle of the other of the two nozzle rows for another color.

The total eight nozzle rows for jetting the four color inks are arranged symmetrically according to the scanning direction. In particular, the two nozzle rows for yellow are arranged adjacently in the center according to the scanning direction. Then, with respect to the above two nozzle rows for yellow, outwardly according to the scanning direction, there are arranged, in the following order, the two nozzle rows for magenta, the two nozzle rows for cyan, and the two nozzle rows for black. That is, from one side to the other side in the scanning direction, the eight nozzle rows are aligned in the order of "K", "C", "M", "Y", "Y", "M", "C", and "K". By arranging the nozzle rows in this manner, the inks are jetted in the same order between the forward moving and the backward moving of the ink jet head for the bidirectional print.

SUMMARY

In such a conventional ink jet head for the bidirectional print as described above, the number of nozzle rows is equal for each of the plurality of types of inks. With respect to this aspect, the present inventors take into consideration a method of increasing the number of rows of only the nozzles jetting a specific ink so as to raise the print speed in jetting that specific ink.

In particular, suppose that, as the nozzle rows for jetting the above specific ink (the black ink, for example), there are provided: (I) nozzle rows in which the positions of the nozzles in the nozzle row direction is coincide with the positions of the nozzles in the nozzle rows for jetting other inks, and which is used simultaneously with the occasion of jetting the other inks, and (II) nozzle rows in which the positions of the nozzles in the nozzle row direction are shifted with respect to the positions of nozzles of the nozzle rows for jetting the other inks in the nozzle row direction, and which are used only on the occasion of jetting the above specific ink.

However, the present inventors have found out problems as described below may arise, because it is necessary to arrange not only the nozzle rows of (I) but also the nozzle rows of (II). In such a bisymmetrical arrangement of the nozzle rows as in the above ink jet head for the bidirectional print, there are two sets of the abovementioned nozzle rows of (I) of the respective nozzles in accordant positions. In this ink jet head for the bidirectional print, the separation distance in the scanning direction between the two nozzle rows of (I) of each set is equal between the two sets. However, if the abovementioned nozzle rows of (II) are arranged, then depending on the arrangement, it is possible to ruin the configuration of the equal separation distance in the scanning direction between the two nozzle rows of (I) of each set of the nozzle rows.

Between the two sets of the nozzle rows of (I), if the separation distance differs between the abovementioned nozzle rows, then between the dots formed by the nozzle rows of one set, and the dots formed by the nozzle rows of the other set, there are different intervals of the time for the plurality of types of inks to land on a recording medium. That is, after a certain type of the inks previously lands on the recording medium, the time varies before another type of the inks comes successively to land, thereby causing a different amount of the previous ink to permeate the recording medium. As a consequence, chromogenic difference of the inks arises between the two dots, thereby resulting in a decrease in image quality.

Accordingly, it is an object of the present teaching to realize both of improving the image quality in the bidirectional print using a plurality of types of inks, and increasing the number of nozzle rows for a specific ink so as to enable high speed printing when using the specific ink only.

According to a first aspect of the present invention, there is provided an ink jet head configured to jet a plurality of types of ink while moving in a scanning direction, the ink jet head including:

a channel structure in which ink channels including a plurality of nozzles are formed; and a pressure application mechanism configured to apply a pressure to the ink inside the ink channels, wherein the channel structure includes:

a first nozzle row for a first ink, a second nozzle row for the first ink and a third nozzle row for a first ink, the nozzles in the first to third nozzle rows for the first ink being aligned in a nozzle array direction intersecting the scanning direction, and a first nozzle row for a second ink and a second nozzle row for the second ink, the nozzles in the first and second nozzle rows for the second ink being aligned in the nozzle array direction;

wherein the first nozzle row for the first ink, the second nozzle row for the first ink and the third nozzle row for the first ink, and the first nozzle row for the second ink and the second nozzle row for the second ink are arranged in the scanning direction;

wherein each of the nozzles in the first nozzle row for the first ink and each of the nozzles in the first nozzle row for the second ink are located at the same position in the nozzle array direction;

wherein each of the nozzles in the second nozzle row for the first ink and each of the nozzles in the second nozzle row for the second ink are located at the same position in the nozzle array direction;

wherein each of the nozzles in the third nozzle row for the first ink is located in a different position in the nozzle array direction with respect to one of the nozzles in the first and second nozzle rows for the first ink;

wherein in the scanning direction, the first and second nozzle rows for the second ink are arranged between the first and second nozzle rows for the first ink, or the first and second nozzle rows for the first ink are arranged between the first and second nozzle rows for the second ink; and wherein a separation distance in the scanning direction between the first nozzle row for the first ink and the first nozzle row for the second ink is equal to a separation distance in the scanning direction between the second nozzle row for the first ink and the second nozzle row for the second ink.

The ink jet head of the present teaching has the first nozzle row, the second nozzle row and the third nozzle row for the first ink, and has the first nozzle row and the second nozzle row for the second ink. Between the first nozzle row for the first ink and the first nozzle row for the second ink, and between the second nozzle row for the first ink and the second nozzle row for the second ink, each nozzle has the same level or position as another nozzle in the nozzle array direction.

Further, the first nozzle row and the second nozzle row for the first ink, and the first nozzle row and the second nozzle row for second ink have such a positional relation that the two nozzle rows of one set are arranged between the nozzle rows of the other set. By virtue of this, between the forward moving and the backward moving, it is possible to equalize the order of jetting the first ink and the second ink (the order of landing the inks on the recording medium).

Further, the third nozzle row for the first ink is dislocated or shifted in the nozzle position with respect to each of the first nozzle row and the second nozzle row for the first ink. Therefore, by jetting the first ink simultaneously from each of the first nozzle row, the second nozzle row, and the third nozzle row, it is possible to carry out high speed print using the first ink only.

In addition to the above characteristics, furthermore, the separation distance in the scanning direction between the first nozzle row for the first ink and the second nozzle row for the second ink with the nozzles in accordant positions is equal to the separation distance in the scanning direction between the second nozzle row for the first ink and the second nozzle row for the second ink likewise with the nozzles in accordant positions. By virtue of this, when carrying out the bidirectional print using the first ink and the second ink, between the first nozzle rows for the first ink and for the second ink, and the second nozzle rows for the first ink and for the second ink, it is also possible to equalize the time from landing the previous ink to landing the successive ink upon the previous. Therefore, between the dots formed by the first nozzle rows for the first ink and for the second ink, and the dots formed by the second nozzle rows for the first ink and for the second ink, the chromogenic difference of the inks decreases, thereby improving the print quality.

According to a second aspect of the present invention, there is provided an ink jet printer including:

the ink jet head as defined in the first aspect of the present teaching;

a head drive portion configured to move the ink jet head in the scanning direction; and a controller configured to control the ink jet head and the head drive portion, and to carry out a first ink jet process and a second ink jet process.

The first ink jet process is to jet the first ink from the first and second nozzle rows for the first ink and jet the second ink from the first and second nozzle rows for the second ink, while moving the ink jet head to one side in the scanning direction, and to jet the first ink from the first and second nozzle rows for the first ink and jet the second ink from the first and second nozzle rows for the second ink, while moving the ink jet head to the other side in the scanning direction.

The second ink jet process is to jet the first ink from the first, second and third nozzle rows for the first ink, while moving the ink jet head in the scanning direction.

In the first ink jet process, in each of the forward moving and the backward moving of the ink jet head, the first ink is jetted from the first nozzle row and the second nozzle row for the first ink, and the second ink is jetted from the first nozzle row and the second nozzle row for the second ink. By virtue of this, between the forward moving and the backward moving of the ink jet head, the order of jetting the first ink and the second ink is identical. Further, because the separation distance in the scanning direction between the first nozzle row for the first ink and the first nozzle row for the second ink is equal to the separation distance in the scanning direction between the second nozzle row for the first ink and the second nozzle row for the second ink, the interval of jetting the first ink and the second ink is also identical.

On the other hand, in the second ink jet process, by jetting the first ink from each of the first nozzle row, the second nozzle row, and the third nozzle row for the first ink, high speed print with the first ink becomes possible.

DESCRIPTION OF THE PREFERRED EMBODIMENT

Next, a preferred embodiment of the present teaching will be explained.

<Schematic Configuration of the Printer>

Figure 1:
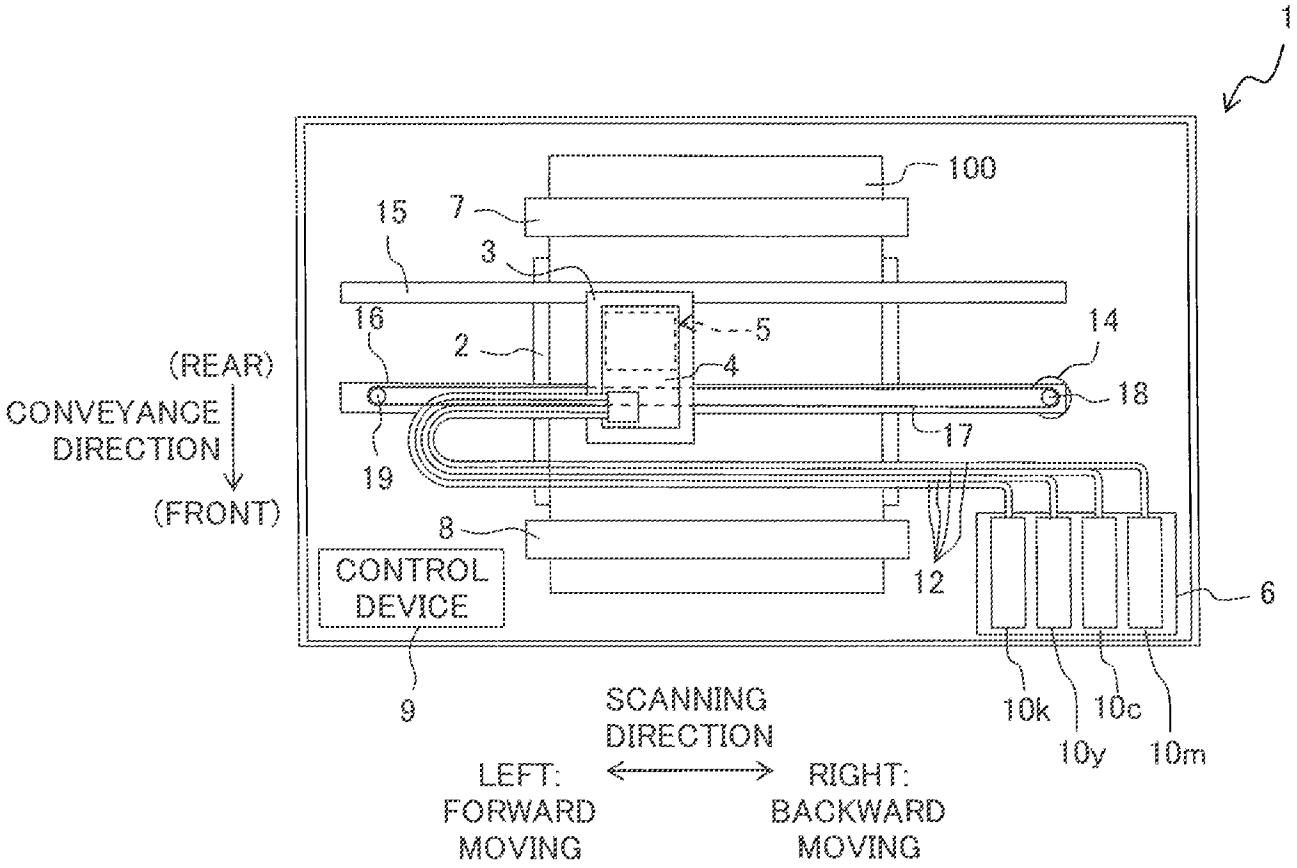
FIG. 1 is a schematic plan view of a printer according to an embodiment of the present invention.

As depicted in FIG. 1, a printer 1 includes a platen 2, a carriage 3, a sub-tank 4, an ink jet head 5, a holder 6, a paper feed roller 7, a paper discharge roller 8, a control device 9, etc. Further, hereinbelow, the near side of the paper-plane of FIG. 1 is defined as "upper side" or "upside" of the printer 1, while the far side of the paper-plane is defined as "lower side" or "downside" of the printer 1. Further, the front-rear direction and the left-right direction depicted in FIG. 1 are defined as "front-rear direction" and "left-right direction" of the printer 1, respectively. The following explanation will be made while appropriately using each directional term of the front-rear, left-right, and up-down.

On the upper surface of the platen 2, there is placed a sheet of recording paper 100 which is a recording medium. Further, above the platen 2, two guide rails 15 and 16 are provided to extend parallel to the left-right direction of FIG. 1 (also referred to as the scanning direction).

The carriage 3 is fitted on the two guide rails 15 and 16, and is movable reciprocatingly in the scanning direction along the two guide rails 15 and 16 in a region facing the platen 2. Further, a drive belt 17 is fitted to the carriage 3. The drive belt 17 is an endless belt fastened on and around two pulleys 18 and 19. The pulley 18 is linked to a carriage drive motor 14. Whenever the carriage drive motor 14 drives the pulley 18 to rotate, the drive belt 17 is caused to operate, thereby reciprocatingly moving the carriage 3 in the scanning direction.

The sub-tank 4 and the ink jet head 5 are mounted on the carriage 3. The sub-tank 4 is connected with the holder 6 through four tubes 12. In the holder 6, there are installed four ink cartridges 10 which are removable and respectively retain inks of four colors (black, yellow, cyan, and magenta). These four color inks are supplied via the tubes 12 from the four ink cartridges 10 installed in the holder 6, respectively.

Further, in the following explanation, among the components of the printer 1, to those corresponding respectively to the inks of black (K), yellow (Y), cyan (C) and magenta (M), letters will be assigned respectively after the reference numerals denoting the components so as to facilitate the knowledge of corresponding to which of the inks. For example, to indicate black, the letter "k" is assigned after the reference numerals denoting the relevant components; to indicate yellow, the letter "y" is assigned after the reference numerals denoting the relevant components; to indicate cyan, the letter "c" is assigned after the reference numerals denoting the relevant components; and to indicate magenta, the letter "m" is assigned after the reference numerals denoting the relevant components. For instance, the ink cartridge 10*k* refers to the ink cartridge 10 retaining the black ink. Further, the term "color-inks" may sometimes be used to collectively refer to the three color inks of yellow, cyan and magenta, excluding the black ink.

The ink jet head 5 is provided below the sub-tank 4. The four color inks are supplied from the sub-tank 4 to the ink jet head 5. Further, the ink jet head 5 has four types of nozzles 47 (see FIG. 3 and FIGS. 4A and 4B) formed in its lower surface to jet the four color inks respectively. Detailed descriptions will be made later on a specific channel structure and the like of the ink jet head 5.

Figure 2:
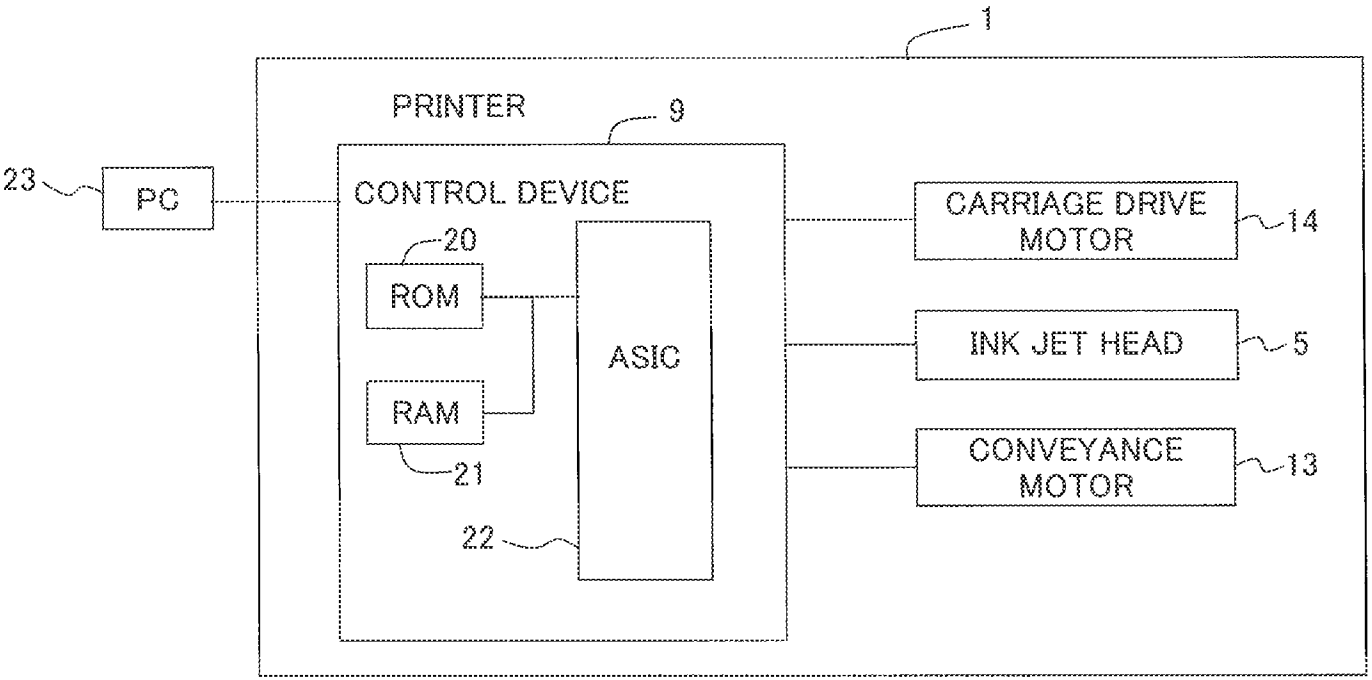
FIG. 2 is a block diagram schematically showing an electrical configuration of the printer.

The paper feed roller 7 and the paper discharge roller 8 are synchronized with each other and driven to rotate by a conveyance motor 13 (see FIG. 2). The paper feed roller 7 and the paper discharge roller 8 cooperate to convey the recording paper 100 positioned on the platen 2 in a conveyance direction (frontward) indicated in FIG. 1.

The control device 9 depicted in FIG. 2 includes a Read Only Memory (ROM) 20, a Random Access Memory (RAM) 21, an Application Specific Integrated Circuit (ASIC) 22 including various control circuits, and the like. As depicted in FIG. 2, the control device 9 is connected with various devices constituting the printer 1 such as the ink jet head 5, the carriage drive motor 14, the conveyance motor 13, and the like. Further, the control device 9 is connected with a PC 23 which is an external device.

Subject to a program stored in the ROM 20, the control device 9 carries out a print process as follows with the ASIC 22. That is, based on a print command sent from the PC 23, the control device 9 controls the ink jet head 5, carriage drive motor 14, conveyance motor 13 and the like to print images, characters and the like on the recording paper 100. In more detail, it causes the plurality of nozzles 47 of the ink jet head 5 to respectively jet the inks and, meanwhile, to cause the carriage 3 to move in the scanning direction, with respect to the recording paper 100 positioned on the platen 2. Further, the two rollers 7 and 8 convey the recording paper 100 in the conveyance direction by a predetermined length. By alternately repeating the ink jet operation of the ink jet head 5 and the conveyance operation of the rollers 7 and 8 as mentioned above, the images and the like are primed on the recording paper 100. Further, while the control device 9 includes the ROM, RAM and ASIC in the above explanation, the present teaching is not limited to such a configuration, but may realize the control device 9 by any other hardware configuration. For example, it may be realized by letting the process shared by two ICs or more such as ASICs and the like.

<Details of the Ink Jet Head>

Figure 3:
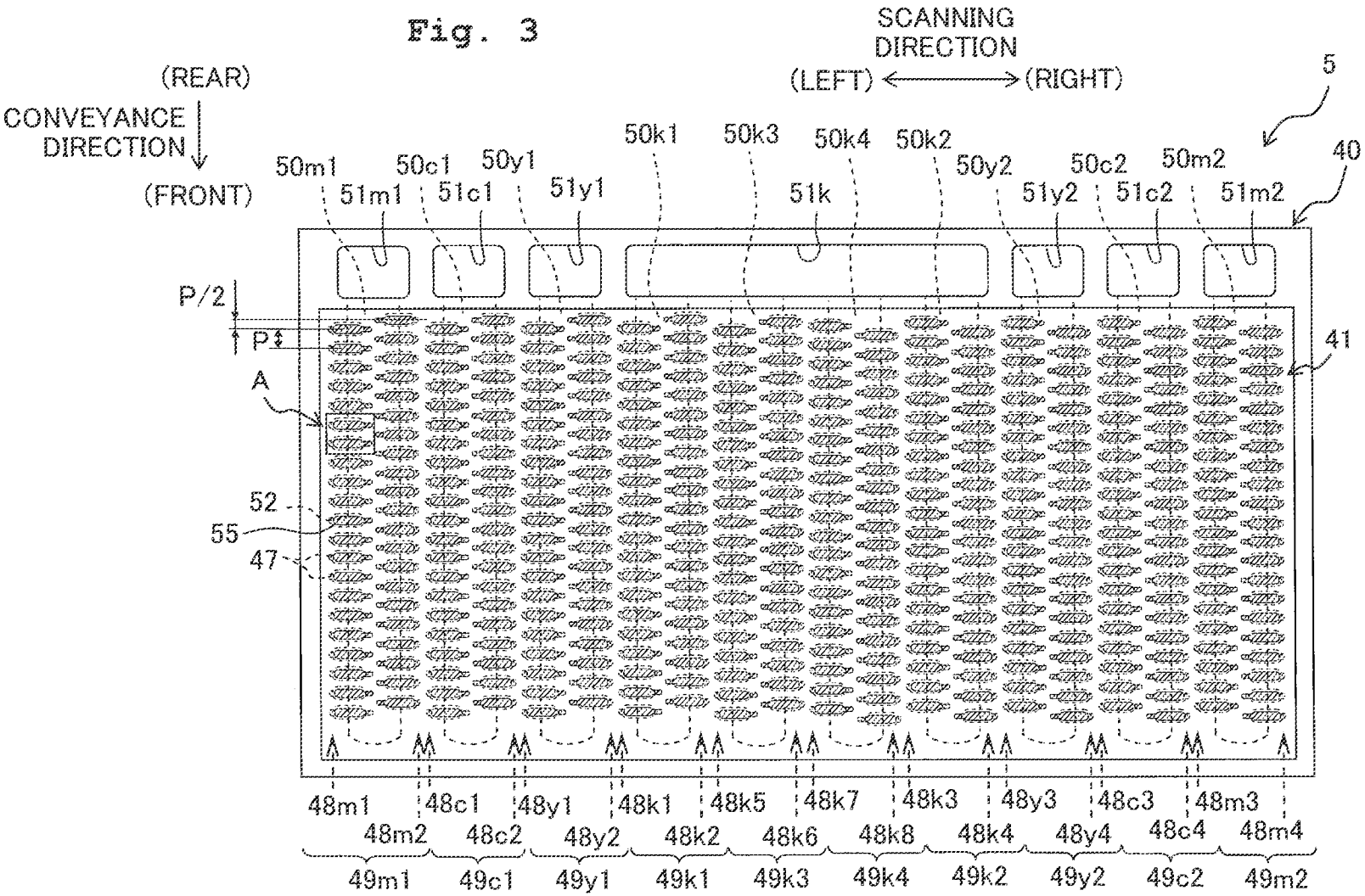
FIG. 3 is a plan view of an ink jet head.
Figure 4A:
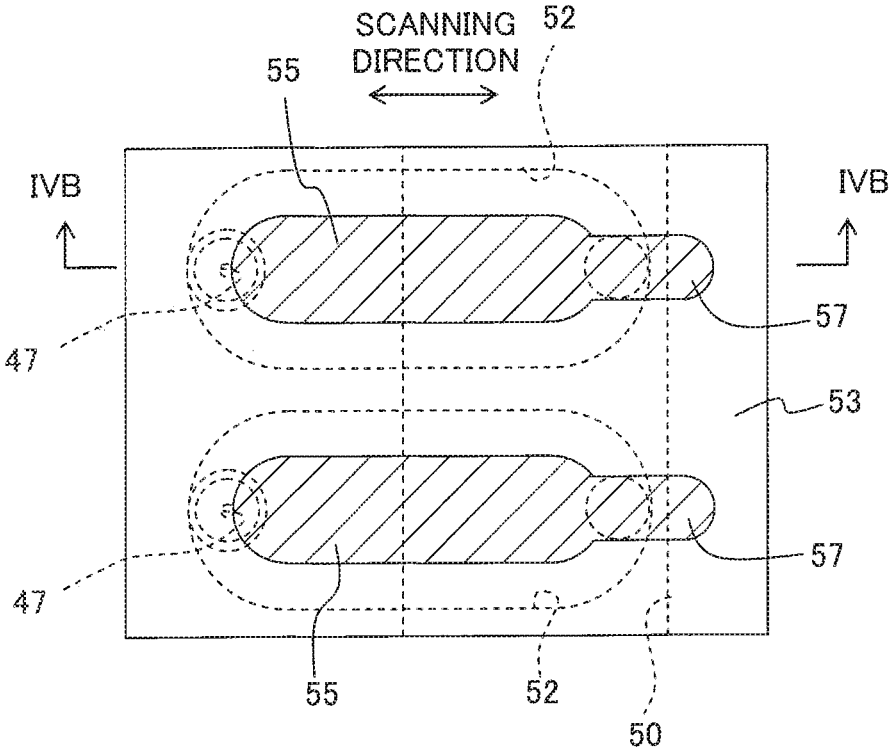
FIG. 4A is an enlarged view of part A of FIG. 3.
Figure 4B:
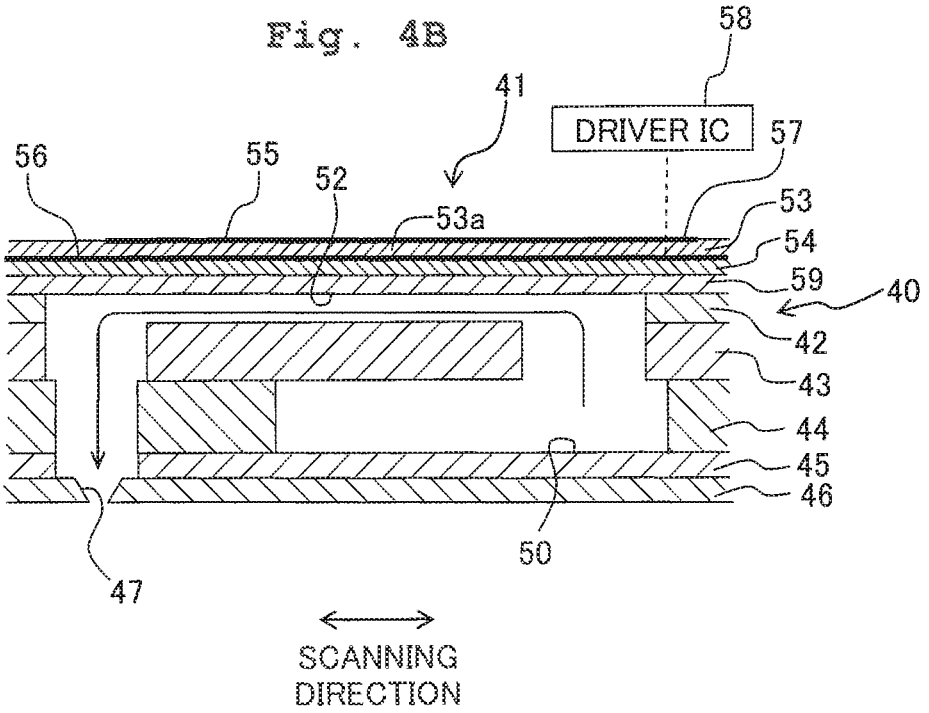
FIG. 4B is a cross-sectional view along the line IVB-IVB of FIG. 4A.

As depicted in FIG. 3 and FIGS. 4A and 4B, the ink jet head 5 includes a channel structure 40 and a piezoelectric actuator 41.

<The Channel Structure>

As depicted in FIG. 4B, the channel structure 40 has a construction of stacking five plates 42 to 46. The lowermost layer plate 46 of the five plates 42 to 46 is a nozzle plate formed with the plurality of nozzles 47. On the other hand, in the other four upper layer plates 42 to 45, channels are formed to include manifolds 50, pressure chambers 52 and the like in communication with the plurality of nozzles 47.

As depicted in FIG. 3, seven supply ports 51 are formed to align in the scanning direction, in the upper surface of such an end portion of the channel structure 40 as on the upstream side in the conveyance direction. These supply ports 51 are supplied with the four color inks from the sub-tank 4 (see FIG. 1) located above the ink jet head 5. The seven supply ports 51 include one supply port 51*k* for black, two supply ports 51*y*1 and 51*y*2 for yellow, two supply ports 51*c*1 and 51*c*2 for cyan, and two supply ports 51*m*1 and 51*m*2 for magenta.

The seven supply ports 51 are aligned in the scanning direction. In detail, the supply port 51*k* for black is arranged in the center according to the scanning direction. Then, toward both the left and right sides from the supply port 51*k* as the center, the supply ports 51 for color-inks are arranged bisymmetrically in the order of the supply ports 51*y*, the supply ports 51*c*, and the supply ports 51*m*.

Further, inside the channel structure 40, the plurality of manifolds 50 are formed to communicate with the seven supply ports 51 and extend in the conveyance direction. In more detail, they are four manifolds 50*k*1 to 50*k*4 in communication with the supply port 51*k* for black, two manifolds 50*y*1 and 50*y*2 in respective communication with the two supply ports 51*y*1 and 51*y*2 for yellow, two manifolds 50*c*1 and 50*c*2 in respective communication with the two supply ports 51*c*1 and 51*c*2 for cyan, and two manifolds 50*m*1 and 50*m*2 in respective communication with the two supply ports 51*m*1 and 51*m*2 for magenta. Further, in the figure, it is configured to supply the ink from the one supply port 51*k* for black to the four manifolds 50*k*1 to 50*k*4. Therefore, the supply port 51*k* for black is larger in aperture size than the supply ports 51 for the other inks. However, this configuration is not necessary but, for example, four supply ports 51*k* may be formed to communicate respectively with the four manifolds 50*k*1 to 50*k*4 for black.

The channel structure 40 has the plurality of nozzles 47 formed in the lowermost layer plate 46, and the plurality of pressure chambers 52 formed in the uppermost layer plate 42. As depicted in FIG. 3, the plurality of nozzles 47 form 20 nozzle rows 48 in total. Detailed explanations will be made later on arrayal of these plurality of nozzles 47. The plurality of pressure chambers 52 are arrayed along the conveyance direction in positions above the manifolds 50 to correspond respectively to the 20 nozzle rows 48 mentioned above. Further, two rows of the pressure chambers are connected to one of the manifolds 50.

As depicted in FIG. 4B, each of the pressure chambers 52 is in communication with the corresponding nozzle 47. Then, as indicated by the arrow in FIG. 4B, inside the channel structure 40, a plurality of individual channels are formed to branch from each of the manifolds 50, pass through the pressure chambers 52, and reach the nozzles 47.

<Piezoelectric Actuator>

The piezoelectric actuator 41 is joined to the upper surface of the channel structure 40 to cover the plurality of pressure chambers 52. As depicted in FIG. 3 and FIGS. 4A and 4B, the piezoelectric actuator 41 includes an ink sealing film 59, two piezoelectric layers 53 and 54, a plurality of individual electrodes 55, and a common electrode 56.

The ink sealing film 59 is a thin film formed of a material of low ink permeability. A metallic material, such as stainless steel or the like, can be used as the material of low ink permeability. The ink sealing film 59 is joined to the upper surface of the channel structure 40 to cover the plurality of pressure chambers 52.

The two piezoelectric layers 53 and 54 are made respectively of a piezoelectric material whose primary ingredient is lead zirconate titanate which is a mixed crystal of lead titanate and lead zirconate. The piezoelectric layers 53 and 54 are arranged on the upper surface of the ink sealing film 59 in such a state as stacked on each other.

The plurality of individual electrodes 55 are arranged on the upper surface of the upper piezoelectric layer 53. In more detail, as depicted in FIGS. 4A and 4B, each of the individual electrodes 55 is arranged in such an area of the upper surface of the piezoelectric layer 53 as to thee the central portion of the corresponding pressure chamber 52. The plurality of individual electrodes 55 are aligned to correspond respectively to the plurality of pressure chambers 52. An individual terminal 57 extends out from each of the individual electrodes 55. An unshown wiring member is connected to the plurality of individual terminals 57. Thus, the plurality of individual electrodes 55 are electrically connected with a driver IC 58 mounted on the wiring member. Based on a signal from the control device 9 (see FIGS. 1 and 2), the driver IC 58 selectively applies one of a predetermined drive potential and the ground potential to each of the individual electrodes 55.

The common electrode 56 is arranged between the two piezoelectric layers 53 and 54. The common electrode 56 faces the plurality of individual electrodes 55 in common across the piezoelectric layer 53. While illustration of a specific electrical connection structure is omitted, a connecting terminal also extends out from the common electrode 56 to the upper surface of the piezoelectric layer 53 and, in the same manner as the plurality of individual electrodes 55, is connected with the wiring member. Connected with a ground wire formed in the wiring member, the common electrode 56 is constantly maintained at the ground potential.

Further, such a portion of the piezoelectric layer 53 as sandwiched between the individual electrodes 55 and the common electrode 56 (referred to as an active portion 53*a*) is polarized in a thickness direction (downward). The active portion 53*a* is a portion where a piezoelectric deformation (piezoelectric strain) occurs when a potential difference arises between the individual electrodes 55 and the common electrode 56 to bring about action of an electric field in the thickness direction.

An explanation will be made on how the abovementioned piezoelectric actuator 41 operates. If the driver IC 58 applies the drive potential to a certain one of the individual electrodes 55, then the potential difference arises between that individual electrode 55 and the common electrode 56. At this time, the electric filed acts in the thickness direction (downward) on the active portion 53*a* of the piezoelectric layer 53 where the direction of the electric field is consistent with the polarization direction of the active portion 53*a*. Therefore, the active portion 53*a* contracts in its planar direction and, along with this, the two piezoelectric layers 53 and 54 bend to project toward the pressure chamber 52. By virtue of this, the pressure chamber 52 changes in volume to give rise to a pressure wave in the individual channel including the pressure chamber 52. Thereby, jet energy is imparted to the ink such that drops of the ink are jetted from the nozzle 47.

(Details of Nozzle Array)

Figure 5:
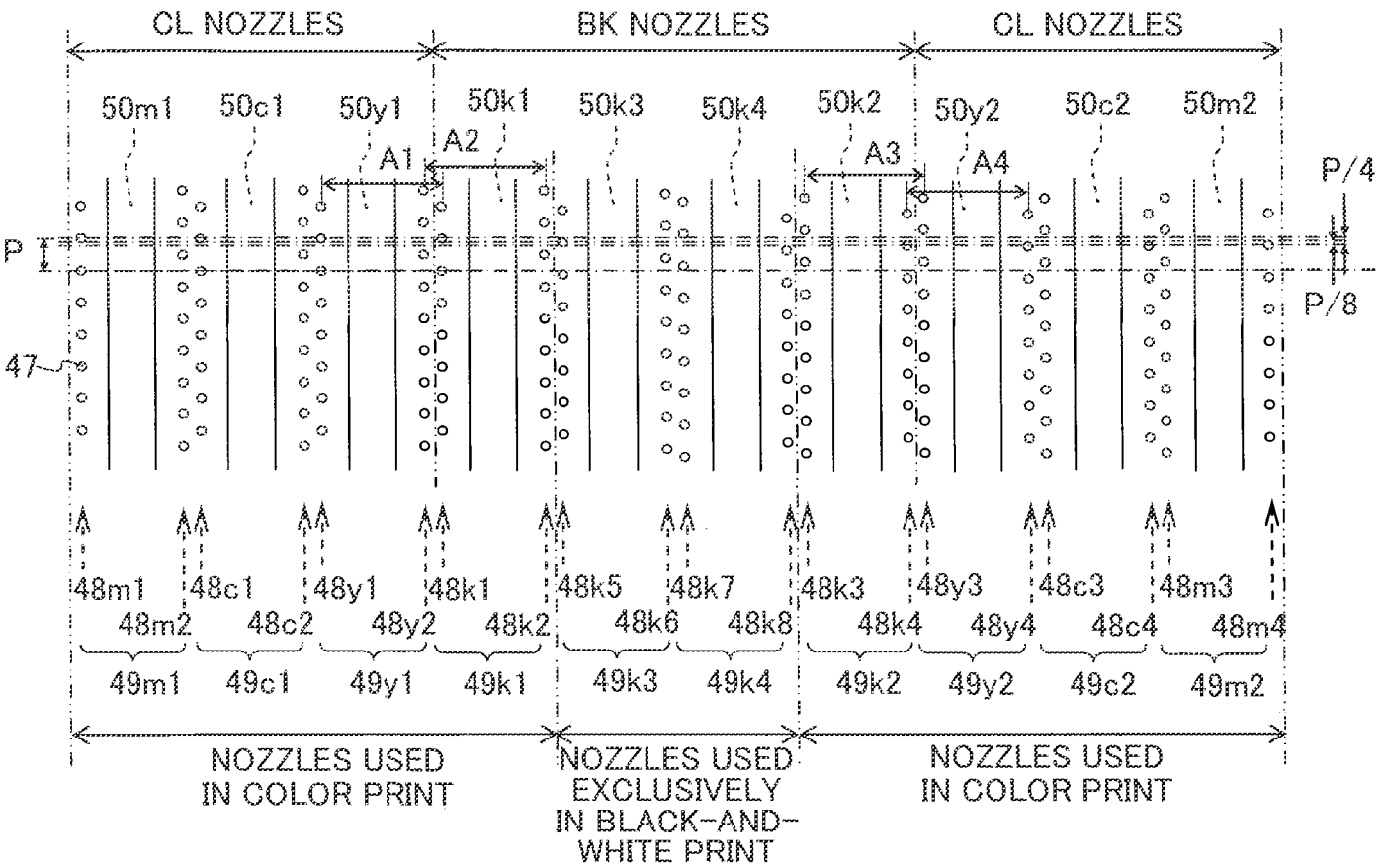
FIG. 5 shows an arrangement of nozzles and manifolds of the ink jet head of FIG. 3.

Next, a detailed explanation will be made on arraying the plurality of nozzles 47 formed in the plate 46. In FIG. 5, the nozzles 47 and the manifolds 50 should have been shown with hidden lines in nature, but are shown here with solid lines. As depicted in FIGS. 3 and 5, in the plate 46, the plurality of nozzles 47 are arrayed at an interval or pitch P along a direction parallel to the conveyance direction, and these plurality of nozzles 47 form the total 20 nozzle rows 48 aligning in the scanning direction. Further, this embodiment is explained supposing that the direction of arraying the plurality of nozzles 47 is orthogonal to the scanning direction but parallel to the conveyance direction. In the following explanation, the direction of arraying the nozzles 47 may sometimes be referred to as the conveyance direction. However, such kind of configuration is not necessary, hut the nozzle array direction of the nozzles 47 may intersect the scanning direction at an angle other than 90 degrees.

The 20 nozzle rows 48 are formed of eight nozzle rows 48*k*1 to 48*k*8 jetting the black ink, four nozzle rows 48*y*1 to 48*y*4 jetting the yellow ink, four nozzle rows 48*c*1 to 48*c*4 jetting the cyan ink, and four nozzle rows 48*m*1 to 48*m*4 jetting the magenta ink. Further, any two nozzle rows 48 respectively jetting an ink of the same color are arranged on both sides of one manifold 50 in the scanning direction to interpose the manifold 50 supplying the ink, and connected with the manifold 50. For example, the manifold 50*k*1 for black is connected with the two nozzle rows 48*k*1 and 48*k*2 arranged on the both sides of the manifold 50*k*1.

Further, for the convenience of the following explanation, the term "nozzle group 49" is used to refer to a group of the nozzles 47 formed of two nozzle rows 48 which jet an ink of the same color and are arranged to interpose one manifold 50. That is, in the channel structure 40 of this embodiment, there are four nozzle groups 49*k*1 to 49*k*4 for black, two nozzle groups 49*y*1 and 49*y*2 for yellow, two nozzle groups 49*c*1 and 49*c*2 for cyan, and two nozzle groups 40*m*1and 49*m*2 for magenta. The two nozzle rows 48 forming one nozzle group 49 are configured to dislocate the nozzles 47 in the conveyance direction by half of the pitch P (P/2) of each nozzle row 48.

The four nozzle groups 49*k*1 to 49*k*4 for black are arranged in the center according to the scanning direction. The two nozzle groups 49*y*1 and 49*y*2 for yellow are arranged on both sides of the four nozzle groups 49*k*1 to 49*k*4 for black according to the scanning direction to interpose these nozzle groups 49*k*1 to 49*k*4 for black. The two nozzle groups 49*c*1 and 49*c*2 for cyan are arranged further outward on both sides, and the two nozzle groups 49*m*1and 49*m*2 for magenta are arranged still further outward on both sides. That is, the nozzle rows 48 (nozzle groups 49) for the color inks of yellow, cyan and magenta are arranged bisymmetrically to interpose the nozzle rows 48 for the black ink according to the scanning direction.

Between the nozzle groups 49*k*1, 49*y*1, 49*c*1 and 49*m*1 for the four colors arranged on the left side, the respective nozzles 47 are equally positioned according to the conveyance direction. Likewise, between the nozzle groups 49*k*2, 49*y*2, 49*c*2 and 49*m*2 for the four colors arranged on the right side, all the nozzles 47 are also equally positioned according to the conveyance direction. Further, the nozzle rows 48 of the nozzle groups 49*k*2, 49*y*2, 49*c*2 and 49*m*2 on the right side are dislocated by P/4 to the downstream side in the conveyance direction, with respect to the nozzle rows 48 of the nozzle groups 49*k*1, 49*y*1, 49*c*1 and 49*m*1 on the left side. For example, the nozzle row 48*k*3 of the nozzle group 49*k*2 is dislocated by P/4 to the downstream side in the conveyance direction with respect to the nozzle row 48*k*2 of the nozzle group 49*k*1. Further, the nozzle row 48*k*4 of the nozzle group 49*k*2 is dislocated by P/4 to the downstream side in the conveyance direction with respect to the nozzle row 48*k*1 of the nozzle group 49*k*1.

The two nozzle groups 49*k*1 and 49*k*2 for black, which accord with the nozzle groups 49 for color in nozzle position according to the conveyance direction, are the nozzle groups 49 which may be used simultaneously with the nozzle groups 49 for color. That is, the two nozzle groups 49*k*1and 49*k*2 are nozzle groups which are usable in color print of images, using all of the four color inks. Of course, the two nozzle groups 49*k*1 and 49*k*2 can also be used in black-and-white print using the black ink only.

The nozzle groups 49*k*3 and 49*k*4 for black are interposed between the nozzle groups 49*k*1 and 49*k*2 for black which may also be used in color print as described above, according to the scanning direction. That is, the nozzle groups 49*k*3 and 49*k*4 for black are located in the center according to the scanning direction, among the total 10 nozzle groups 49. The nozzles 47 of the nozzle rows 48 forming the nozzle groups 49*k*3 and 49*k*4 are dislocated in the conveyance direction with respect to the nozzle rows 48 forming the nozzle group 49*k*1 and the nozzle group 49*k*2. By virtue of this, the respective nozzles 47 of the total eight nozzle rows 48*k*1 to 48*k*8, which form the four nozzle groups 49*k*1 to 49*k*4, are arrayed in the conveyance direction at a pitch of P/8. Further, the nozzle groups 49*k*3 and 49*k*4 do not accord with the nozzle groups 49*y*, 49*c* and 49*m* for the color inks in the position of each nozzle 47 according to the conveyance direction. That is, the nozzle groups 49*k*3 and 49*k*4 are nozzle groups which are exclusively used in black-and-white print using the black ink only, but not used in color print.

Further, as depicted in FIG. 5, regarding the nozzle groups 49*k*1, 49*y*1, 49*c*1 and 49*m*1 on the left side for the use of color print, the separation distance between one of the two nozzle rows 48 of the nozzle group 49*k*1 and one of the two nozzle rows 48 of the nozzle groups 49*y*1 is equal to the separation distance between the other of the two nozzle rows 48 of the nozzle group 49*k*1 and the other of the two nozzle rows 48 of the nozzle groups 49*y*1 in the scanning direction. In addition, the separation distance between one of the two nozzle rows 48 of the nozzle group 49*k*1 and one of the two nozzle rows 48 of the nozzle groups 49*c*1 is equal to the separation distance between the other of the two nozzle rows 48 of the nozzle group 49*k*1 and the other of the two nozzle rows 48 of the nozzle groups 49*c*1 in the scanning direction. Further, the separation distance between one of the two nozzle rows 48 of the nozzle group 49*k*1 and one of the two nozzle rows 48 of the nozzle groups 49*m*1 is equal to the separation distance between the other of the two nozzle rows 48 of the nozzle group 49*k*1 and the other of the two nozzle rows 48 of the nozzle groups 49*m*1 in the scanning direction. In particular, a separation distance A1 in the scanning direction between the nozzle row 48*k*1 for black and the nozzle row 48*y*1 for yellow, where the nozzles 47 are located in accordant positions, is equal to a separation distance A2 in the scanning direction between the nozzle row 48*k*2 for black and the nozzle row 48*y*2 for yellow, where the nozzles 47 are located likewise in accordant positions. Further, much the same is true on the nozzle groups 49*k*2, 49*y*2, 49*c*2 and 49*m*2 on the right side: a separation distance A3 in the scanning direction between the nozzle row 48*k*3 for black and the nozzle row 48*y*3 for yellow is equal to a separation distance A4 in the scanning direction between the nozzle row 48*k*4 for black and the nozzle row 48*y*4 for yellow, where the nozzles 47 are located in accordant positions according to the conveyance direction.

Further, between the nozzle groups 49*k*1, 49*y*1, 49*c*1 and 49*m*1 on the left side, and the nozzle groups 49*k*2, 49*y*2, 49*c*2 and 49*m*2 on the right side, the abovementioned separation distance in the scanning direction is equal. That is, A1=A2=A3=A4.

Using the ink jet head 5 having the above nozzle arrays, the control device 9 is able to cause the printer 1 to carry out prints as follows.

<Color Print: First Ink Jet Process>

When the ink jet head 5 either moves leftward (to be referred to hereinbelow as forward moving) or moves rightward (to be referred to hereinbelow as backward moving), the control device 9 causes the four color inks to be jetted respectively from the four nozzle groups 49*k*1, 49*y*1, 49*c*1 and 49*m*1 on the left side, and from the four nozzle groups 49*k*2, 49*y*2, 49*c*2 and 49*m*2 on the right side. By virtue of this, the ink jet head 5 is caused to move back and forth in the scanning direction while a color print is carried out on the recording paper 100 with a dot pitch of P/4. In this case, either in the forward moving or in the backward moving, the order of jetting the four color inks is: M→C→Y→K→K→Y→C→M, thereby equalizing the order of landing the inks on the recording paper 100. In this manner, between the forward moving and the backward moving, by equalizing the order of landing the four color inks, difference in coloration is suppressed, and a high image quality can be obtained.

<Black-and-White Print: Second Ink Jet Process>

The control device 9 causes the carriage 3 to move in the scanning direction while letting the black ink be jetted respectively from the total eight nozzle rows 48*k*1 to 48*k*8 of the four nozzle groups 49*k*1 to 49*k*4. By virtue of this, it is possible for the ink jet head 5 to move in the scanning direction while carrying out a black-and-white print at high speed and at high resolution with a dot pitch of P/8. Further, while such a black-and-white print may be carried out in a bidirectional print just as in the color print, the black-and-white print may also be carried out in a unidirectional print, that is, jetting the ink only in one way (in the forward moving or in the backward moving).

As described above, in this embodiment, the separation distance is equal between the nozzle rows 48 of the nozzle group 49*k*1 and the nozzle rows 48 of the nozzle groups 49*y*1, 49*c*1 or 49*m*1 for color on the left side (A1=A2), and the separation distance is also equal between the nozzle rows 48 of the nozzle group 49*k*2 and the nozzle rows 48 of the nozzle groups 49*y*2, 49*c*2 or 49*m*2 for color on the right side (A3=A4). Further, the above separation distance is also equal between the left side and the right side. That is, A1→A2=A3=A4.

According to the above, when carrying out a color print in the bidirectional print, between the case for the nozzle groups 49*k*1, 49*y*1, 49*c*1 and 49*m*1 on the left side to jet the inks, and the ease for the nozzle groups 49*k*2, 49*y*2, 49*c*2 and 49*m*2 on the right side to jet the inks, the time is equal from the landing of a previous ink to the landing of the successive ink on the previous. Therefore, the chromogenic difference of the inks between the dots decreases, thereby improving the image quality.

Further, in this embodiment, the four nozzle groups 49*k*1 to 49*k*4 (the eight nozzle rows 48*k*1 to 48*k*8) jetting the black ink are arranged between the nozzle groups 49*y*1, 49*c*1 and 49*m*1, and the nozzle groups 49*y*2, 49*c*2 and 49*m*2, which jet the color inks. In this configuration, because the eight nozzle rows 48*k*1 to 48*k*8 are arranged to concentrate in the center to jet the same black ink, the arrangement area becomes small in the scanning direction for the nozzle rows 48*k*1 to 48*k*8 used in the black-and-white print. Therefore, when carrying out the black-and-white print in the bidirectional print while alternately reversing the orientations of the ink jet head 5, it is possible to narrow the scanning range of the carriage 3 in the forward moving and in the backward moving, thereby raising the print speed. Further, by arranging the eight nozzle rows 48*k*1 to 48*k*8 settle in the center, it is possible to simplify the pathway for supplying the black ink to those nozzle rows 48*k*1 to 48*k*8. For example, it is possible to share the supply port 51*k* to supply the ink to the eight nozzle rows 48*k*1 to 48*k*8.

The nozzle groups 49*k*3 and 49*k*4 for black only used in the black-and-white print have less opportunity to jet the ink than the nozzle groups 49*k*1 and 49*k*2 also used in the color print. Therefore, the ink in the nozzles 47 is more likely to be thickened by drying. In this respect, because the nozzle groups 49*k*3 and 49*k*4 for black only used in the black-and-white print are arranged between the nozzle groups 49*k*1 and 49*k*2 also used in the color print, it is possible to delay the drying process of the nozzles 47 belonging to the nozzle groups 49*k*3 and 49*k*4 having less opportunity to jet.

Further, in this embodiment, in order to suppress the ink thickening in each of the nozzles 47, it is possible to apply such a technique as to let the control device 9 control the driver IC 58 to provide the ink with just as much energy as not let the ink be jetted from any nozzle 47, to vibrate the ink inside the nozzle 47. In this ease, however, when vibrating the ink in a certain nozzle 47, it is conceivable that affected by the vibration, some adjacent nozzles 47 may change in ink jet characteristic. Further, because the nozzle groups 49*k*3 and 49*k*4 used only in the black-and-white print do not jet the ink while the other nozzle groups 49 are being used to carry out a color print, it is sometimes necessary to perform the above-mentioned ink vibration for preventing the thickening during the color print. In this regard, in this embodiment, the nozzle groups 49*k*3 and 49*k*4 are therefore arranged in the center, and thus the nozzle groups 49*k*1 and 49*k*2 are the only nozzle groups 49 adjacent to the nozzle groups 49*k*3 and 49*k*4. That is, when the ink vibration is brought about in the nozzle groups 49*k*3 and 49*k*4, the vibration becomes less likely to affect the nozzle groups 49 for the color inks.

In the embodiment explained above, the control device 9 corresponds to the controller of the present teaching. The carriage drive motor 14 corresponds to the head drive portion of the present teaching. The black ink corresponds to the first ink of the present teaching, while the color inks (yellow, magenta, and cyan) correspond to the second ink of the present teaching. The two nozzle rows 48*k*1 and 48*k*2 forming the nozzle group 49*k*1 correspond to the first nozzle row for the first ink of the present teaching, while the two nozzle rows 48*k*3 and 48*k*4 forming the nozzle group 49*k*2 correspond to the second nozzle row for the first ink of the present teaching. The two nozzle rows 48*k*5 and 48*k*6 forming the nozzle group 49*k*3, and the two nozzle rows 48*k*7 and 48*k*8 forming the nozzle group 49*k*4 correspond to the third nozzle row for the first ink of the present teaching. The two nozzle rows 48 forming the nozzle groups 49*y*1, 49*c*1 or 49*m*1 correspond to the first nozzle row for the second ink of the present teaching, while the two nozzle rows 48 forming the nozzle groups 49*y*2, 49*c*2 or 49*m*2 correspond to the second nozzle row for the second ink of the present teaching.

Next, explanations will be made on several modifications which have applied various changes to the above embodiment. However, the same reference signs are assigned to the components identical or similar in configuration to those in the above embodiment, and any explanation therefore will be omitted.

<First Modification>

In the above embodiment, the channel structure 40 is configured to have the four manifolds 50*k*1 to 50*k*4 corresponding respectively to the four nozzle groups 49*k*1 to 49*k*4 for black. However, there is no particular need of one-to-one correspondence between the nozzle groups 49*k* for black and the manifolds 50*k*.

Figure 6:
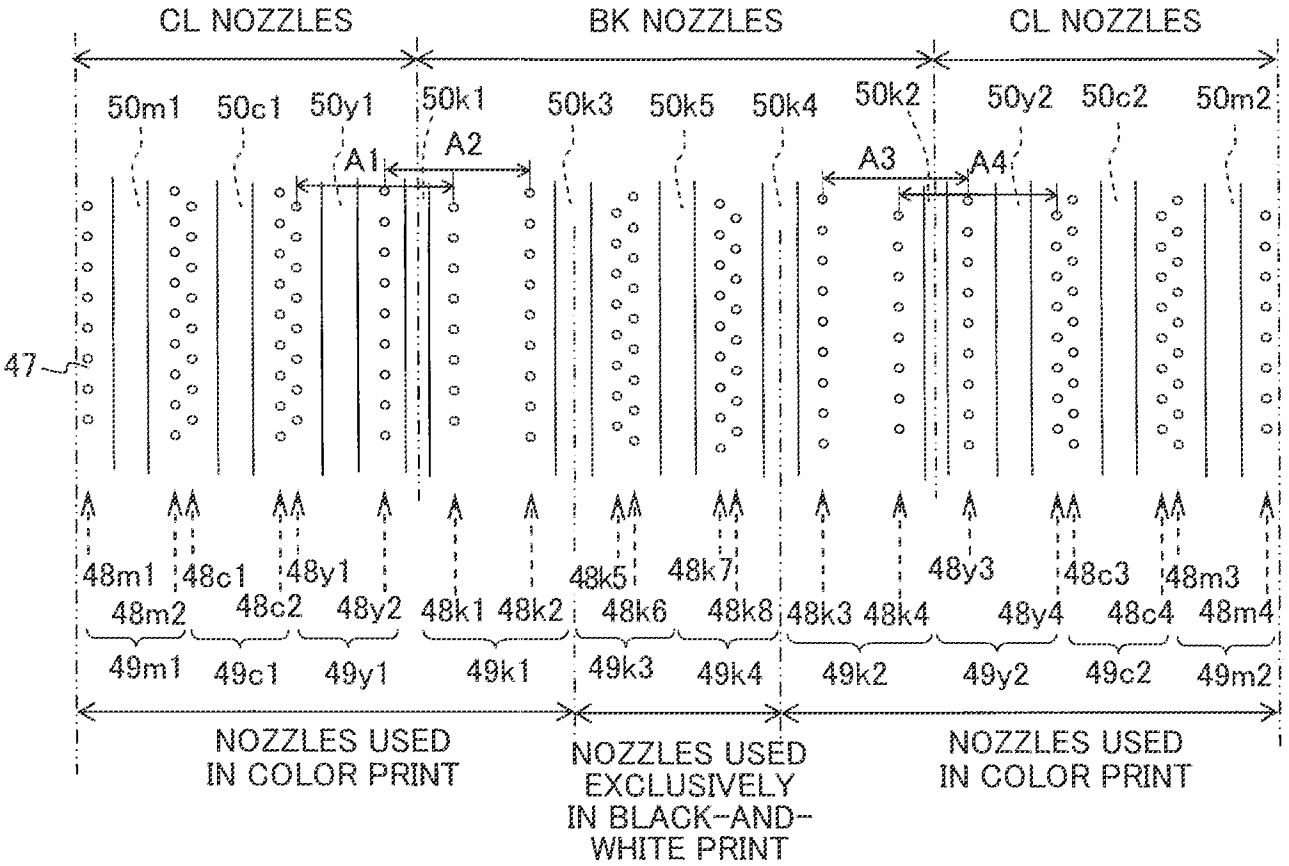
FIG. 6 shows an arrangement of nozzles and manifolds of an ink jet head according to a modification of the embodiment.

In FIG. 6, five manifolds 50*k*1 to 50*k*5 are provided for the four nozzle groups 49*k*1 to 49*k*4 for black (the eight nozzle rows 4816 to 48*k*8). The leftmost manifold 50*k*1 is connected only to the nozzle row 48*k*1 of the nozzle group 49*k*1 used in color print. Likewise, the rightmost manifold 50*k*2 is connected only to the nozzle row 48*k*4 of the nozzle group 49*k*2 used in color print.

Each of the three central manifolds 50*k*3 to 50*k*5 is connected to the two nozzle rows 48*k* arranged on the both sides thereof. In detail, the manifold 50*k*3 is connected to the nozzle row 48*k*2 used in color print and the nozzle row 48*k*5 used only in black-and-white print Likewise, the manifold 50*k*4 is connected to the nozzle row 48*k*3 used in color print and the nozzle row 48*k*8 used only in black-and-white print. On the other hand, the centermost manifold 50*k*5 is connected to each of the nozzle row 48*k*6 and the nozzle row 48*k*7 used only in black-and-white print.

In the configuration of FIG. 6, the nozzle rows 48*k*1 and 48*k*2 (corresponding to the first nozzle row for the first ink according to the present teaching) and the nozzle rows 48*k*3 and 48*k*4 (corresponding to the second nozzle row for the first ink according to the present teaching), which are used in color print, are connected respectively to the different manifolds 50*k*1 to 50*k*4. Therefore, the inks are supplied respectively from the different manifolds 50*k* to these four nozzle rows 48*k*1 to 48*k*4.

Further, it is also possible to connect the nozzle rows 48*k*5 to 48*k*8 used only in black-and-white print to other manifolds 50 than the manifolds 50*k*1 to 50*k*4 connected with the nozzle rows 48*k*1 to 48*k*4 used in color print in such cases, however, because the number of manifolds 50 increases, the ink jet head grows in width in the scanning direction. Hence, in FIG. 6, the manifold 50*k*3 connected to the nozzle row 48*k*2 used in color print is also connected to the nozzle row 48*k*5 (the third nozzle row according to the present teaching) used only in black-and-white print. In the same manner, the manifold 50*k*4 connected to the nozzle row 48*k*3 used in color print is also connected to the nozzle row 48*k*8 (the third nozzle row according to the present teaching) used only in black-and-white print.

Because the nozzle row 48*k*5 (48*k*8) is not used in color print, on the occasion of color print, the inks are supplied only to the four nozzle rows 48*k*1 to 48*k*4 from the four manifolds 50*k*1 to 50*k*4. Therefore, especially during the time of color print, in each of the nozzle rows 48*k*1 to 48*k*4, it is less likely to give rise to a defective jet due to insufficient ink supply. In the configuration of FIG. 6, the manifolds 50*k*1 to 50*k*5 correspond to the first common ink chambers of the present teaching, while the manifolds 50*y*1, 50*y*2, 50*c*1, 50*c*2, 50*m*1 and 50*m*2 correspond to the second common ink chambers of the present teaching.

Further, in FIG. 6, while the two nozzle rows 48 for color are arranged across the manifold 50 on both sides, the two nozzle rows 48*k*1 and 48*k*2 (48*k*3 and 48*k*4) of the nozzle group 49*k*1 (49*k*2) for black, which are usable simultaneously with the nozzle rows 48 for color, are arranged without interposing any manifold 50 therebetween. Therefore, differing from the above embodiment, if the nozzle rows 48*k* for black are ordinarily arranged, then the separation distance A1 in the scanning direction between the nozzle row 48*k*1 for black and the nozzle row 48*y*1 for yellow would be different from the separation distance A2 in the scanning direction between the nozzle row 48*k*2 for black and the nozzle row 48*y*2 for yellow. Further, much the same is true on the separation distance A3 in the scanning direction between the nozzle row 48*k*3 and the nozzle row 48*y*3, and on the separation distance A4 in the scanning direction between the nozzle row 48*k*4 and the nozzle row 48*y*4. In FIG. 6, therefore, the interval is widened between the nozzle row 48*k*1 and the nozzle row 48*k*2, as well as between the nozzle row 48*k*3 and the nozzle row 48*k*4. By virtue of this, A1=A2=A3=A4 can be realized.

In addition, in FIG. 6, regardless of whether or not a manifold 50 is present therebetween, by adopting such a configuration as to arrange all the nozzle rows 48 equidistantly, it is still possible to realize A1=A2=A3=A4.

Further, it is also possible to adopt a configuration of one-to-one correspondence between a manifold and each of the plurality of nozzle rows 48, that is, a configuration where one manifold 50 is connected to only one nozzle row 48. This configuration may either be adopted for the nozzle rows 48*k* only or be adopted for all the nozzle rows 48 including those for color.

<Second Modification>

In the above embodiment, a number of nozzle rows 48 for black are arranged in the center according to the scanning direction, while the nozzle rows 48 for color are arranged separately on both sides to interpose the nozzle rows 48 for black therebetween in the scanning direction. However, the arrangement relation of interposition may be reversed between the nozzle rows 48 for black and the nozzle rows 48 for color.

<Third Modification> in the above embodiment, regarding the nozzle groups 49 used in color print, the nozzles 47 of the nozzle groups 49*k*1, 49*y*1, 49*c*1 and 49*m*1 on the left side are shifted from the nozzles 47 of the nozzle groups 49*k*2, 49*y*2, 49*c*2 and 49*m*2 on the right side, in the conveyance direction. In contrast to this configuration, the nozzles 47 of the nozzle groups 49*k*1, 49*y*1, 49*c*1 and 49*m*1 on the left side, and the nozzles 47 of the nozzle groups 49*k*2, 49*y*2, 49*c*2 and 49*m*2 on the right side may be located in accordant positions in the conveyance direction. In such a configuration, when carrying out the bidirectional print, the nozzle groups 49*k*1, 49*y*1, 49*c*1 and 49*m*1 on the left side are used exclusively for the forward moving (or backward moving), whereas the nozzle groups 49*k*2, 49*y*2, 49*c*2 and 49*m*2 on the right side are used exclusively for the backward moving (or forward moving).

<Fourth Modification>

Figure 7:
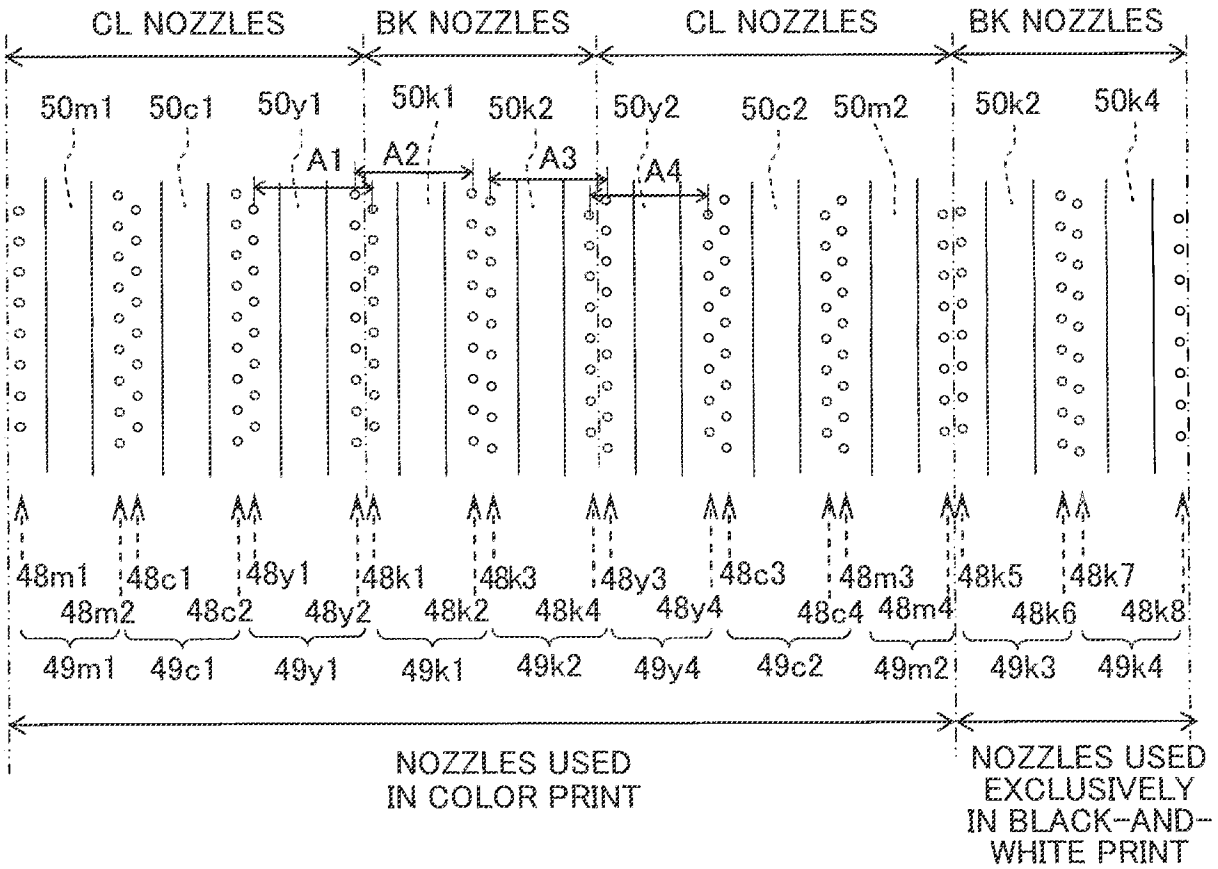
FIG. 7 shows an arrangement of nozzles and manifolds of an ink jet head according to another modification.

In FIG. 5 for the above embodiment, the nozzle groups 49*k*3 and 49*k*4 for black used only in black-and-white print are interposed between the nozzle groups 49*k*1 and 49*k*2 used also in color print. However, without being limited to this configuration, for example, the nozzle groups 49*k*3 and 49*k*4 used only in black-and-white print may be arranged outside, and thus the nozzle groups 49*k*1 and 49*k*2 used also in color print are arranged inside. Further, the nozzle groups 49*k*3 and 49*k*4 used only in black-and-white print may also be arranged away from the nozzle groups 49*k*1 and 49*k*2 used also in color print. As depicted in FIG. 7 for example, the nozzle groups 49*k*3 and 49*k*4 may be arranged outside of the nozzle group 49*m*2 (or the nozzle group 49*m*1) for magenta, according to the scanning direction.

<Fifth Modification>

The number of nozzle rows 48 for each color used in color print is two or more, and is not particularly limited as long as it is allocable to both the left and right sides. Further, two or more of the nozzle rows 48 used in color print may be allocated such that the number of nozzle rows 48 differs between the left side and the right side. Further, the number of nozzle rows 48 for black used in black-and-white print is not particularly limited either.

<Sixth Modification>

In the above embodiment, the nozzle rows 48 of the nozzles 47 in accordant positions are arranged to stay on the same side according to the scanning direction. In particular, in FIG. 5, the nozzle groups 49*k*1, 49*y*1, 49*c*1, and 49*m*1 are arranged on the left side, while the nozzle groups 49*k*2, 49*y*2, 49*c*2, and 49*m*2 are arranged on the right side. In contrast to this arrangement, as depicted in FIG. 8, the four-color nozzle rows of the respective nozzles 47 in accordant positions may be arranged separately on the left and on the right.

Figure 8:
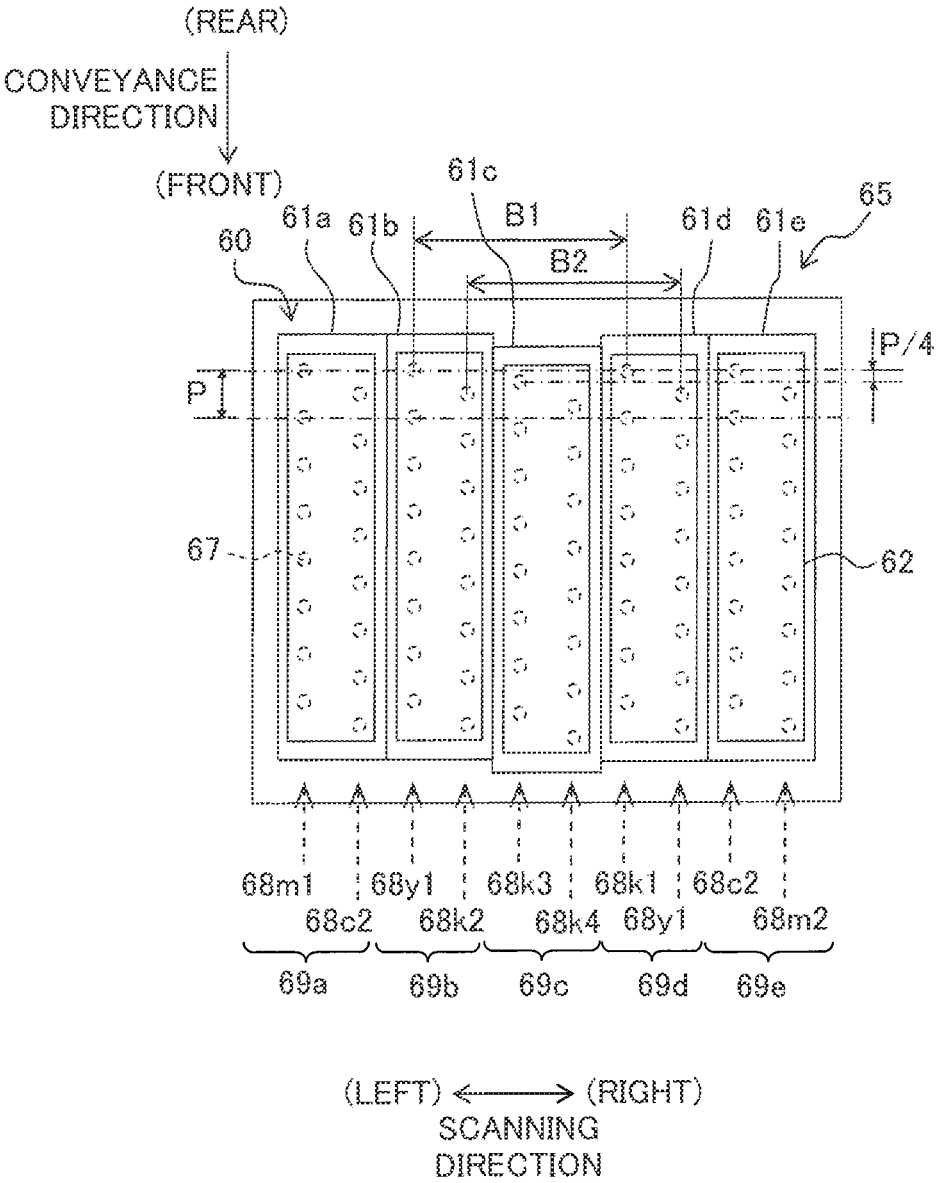
FIG. 8 is a plan view of an ink jet head according to still another modification.

A channel structure 60 of an ink jet head 65 depicted in FIG. 8 has nozzle rows 68*k*1, 68*k*2, 68*k*3 and 68*k*4 for black, nozzle rows 68*y*1 and 68*y*2 for yellow, nozzle rows 68*c*1 and 68*c*2 for cyan, and nozzle rows 68*m*1 and 68*m*2 for magenta. Further, in the above embodiment, all of the four-color nozzle rows are formed in the one channel structure 40. In FIG. 8, however, the channel structure 60 is configured to have five channel units 61*a* to 61*e*, and two nozzle rows adjacent to each other are formed in each channel unit 61. Further, each channel unit 61 is provided with a piezoelectric actuator 62. Regarding the nozzle row 68*k*1 for black, the nozzle row 68*y*1 for yellow, the nozzle row 68*c*1 for cyan, and the nozzle row 68*m*1 for magenta, the respective nozzles 67 are located in accordant positions. Further, regarding the nozzle row 68*k*2 for black, the nozzle row 68*y*2 for yellow, the nozzle row 68*c*2 for cyan, and the nozzle row 68*m*2 for magenta, the respective nozzles 67 are also located in accordant positions. That is, the nozzle rows 68*k*1 and 68*k*2 for black may also be used in color print. The nozzle rows 68*k*1, 68*y*1, 68*c*1 and 68*m*1, and the nozzle rows 68*k*2, 68*y*2, 68*c*2 and 68*m*2 are configured to dislocate the respective nozzles 67 in the arrayal direction (here, the conveyance direction), by half of the pitch P (P/2) of each nozzle row.

Each nozzle 67 of the nozzle row 68*k*3 is shifted by P/4 to the downstream side in the conveyance direction with respect to the nozzle rows 68*k*1, 68*y*1, 68*c*1, and 68*m*1. Each nozzle 67 of the nozzle row 68*k*4 is shifted by P/4 to the downstream side in the conveyance direction with respect to the nozzle rows 68*k*2, 68*y*2, 68*c*2, and 68*m*2. Further, each nozzle 67 of the nozzle row 68*k*4 for black is shifted by P/2 with respect to the nozzle row 68*k*3. These nozzle rows 68*k*3 and 68*k*4 for black are used only in black-and-white print.

The nozzle row 68*k*3 and nozzle row 68*k*4 for black are arranged in the center according to the scanning direction. The nozzle row 68*k*1 for black and the nozzle row 68*y*2 for yellow are arranged on the right side of the nozzle rows 68*k*3 and 68*k*4. Further to the right side, there are arranged the nozzle row 68*c*1 for cyan and the nozzle row 68*m*2 for magenta. On the other hand, the nozzle row 68*k*2 for black and the nozzle row 68*y*1 for yellow are arranged on the left side of the nozzle rows 68*k*3 and 68*k*4. Further to the left side, there are arranged the nozzle row 68*c*2 for cyan and the nozzle row 68*m*1 for magenta. That is, among the four-color nozzle rows 68*k*1, 68*y*1, 68*c*1 and 68*m*1 of the nozzles 67 in accordant positions, the nozzle row 68*k*1 and the nozzle row 68*c*1 are arranged on the right side, while the nozzle row 68*y*1 and the nozzle row 68*m*1 are arranged on the left side. Further, among the four-color nozzle rows 68*k*2, 68*y*2, 68*c*2, and 68*m*2, the nozzle row 68*k*2 and the nozzle row 68*c*2 are arranged on the left side, while the nozzle row 68*y*2 and the nozzle row 68*m*2 are arranged on the right side.

Further, a separation distance B1 in the scanning direction between the nozzle row 68*k*1 for black and the nozzle row 68*y*1 for yellow is equal to a separation distance B2 in the scanning direction between the nozzle row 68*k*2 for black and the nozzle row 68*y*2 for yellow, where the nozzles 47 are located in accordant positions. Much the same is true on the separation distances between the nozzle row 68*k*1 (68*k*2) for black, the nozzle row 68*c*1 (68*c*2) for cyan, and the nozzle row 68*m*1 (68*m*2) for magenta.

In this configuration, the nozzle row 68*k*1 corresponds to the first nozzle row for the first ink according to the present teaching, while the nozzle row 68*k*2 corresponds to the second nozzle row for the first ink according to the present teaching. The nozzle row 68*k*3 corresponds to the third nozzle row for the first ink according to the present teaching, while the nozzle row 68*k*4 corresponds to the fourth nozzle row for the first ink according to the present teaching. Further, the nozzle rows 68*y*1, 68*c*1, and 68*m*1 correspond to the first nozzle row for the second ink according to the present teaching, while the nozzle rows 68*y*2, 68*c*2, and 68*m*2 correspond to the second nozzle row for the second ink according to the present teaching.

In the configuration of FIG. 8, when two adjacent nozzle rows 68 are defined as one nozzle group 69, then there are five nozzle groups 69*a* to 69*e* in total. Those are, from the left, the nozzle group 69*a* formed of the nozzle rows 68*m*1 and 68*c*2, the nozzle group 69*b* formed of the nozzle rows 68*y*1 and 68*k*2, the nozzle group 69*c* formed of the nozzle rows 68*k*3 and 68*k*4, the nozzle group 69*d* formed of the nozzle rows 68*k*1 and 68*y*2, and the nozzle group 69*e* formed of the nozzle rows 68*c*1 and 68*m*2. Then, as depicted in FIG. 8, between these five nozzle groups 69*a* to 69*e*, the nozzles are all arrayed identically. Because of such kind of configuration, it becomes possible to completely uniform the members, structures and the like corresponding respectively to the five nozzle groups 69*a* to 69*e*. A specific example will be shown hereinbelow.

As described earlier, in FIG. 8, the channel structure 60 of the ink jet head 5 has the five channel units 61*a* to 61*e* having the five nozzle groups 69*a* to 69*e* respectively. Each of the channel unit 61 is provided with the piezoelectric actuator 62. Because the nozzle array is identical between the five nozzle groups 69*a* to 69*e*, it is possible to uniform the structures of the respective ink channels (the nozzles, pressure chambers, and manifolds) between the five channel units 61*a* to 61*e*. By virtue of this, because it is possible to construct the channel structure 60 by combining the five channel units 61 of one type, there is a cost advantage. Further, because the nozzle group 69*c* formed of the nozzle rows 68*k*3 and 68*k*4 needs to be dislocated by P/4 with respect to the other nozzle groups 69, the central channel unit 61*c* having the nozzle group 69*c* is structured identically with the other four channel units 61 and, on top of that as depicted in FIG. 8, is dislocated by P/4 to the downstream side in the conveyance direction with respect to the other four channel units 61, in this configuration, the five channel units 61 correspond to the channel member according to the present teaching.

Further, the whole ink channel of each channel unit 61 does not necessarily need to have the same structure, but it is possible to uniform only sonic members forming part of the ink channel. For example, the channel structure 60 may have five nozzle plates formed respectively with the five nozzle groups 69*a* to 69*e*, and these five nozzle plates may have an identical structure. Further, the five piezoelectric actuators 62 may have an identical structure. In these configurations, it is possible to differently structure the channel plates, piezoelectric actuators 62 and the like other than the members structured identically, between the five nozzle groups 69*a* to 69*e* in the channel structure 60. Alternatively, it is also possible to let one common member form the channel plates, piezoelectric actuators 62 and the like other than the members structured identically, crossing over between the five nozzle groups 69*a* to 69*e*.

What is claimed is:

1. An ink jet head configured to jet a plurality of types of ink while moving in a scanning direction, the ink jet head comprising:

a channel structure in which ink channels including a plurality of nozzles are formed; and a pressure application mechanism configured to apply a pressure to the ink inside the ink channels;

wherein the channel structure includes:

a first nozzle row for a first ink, a second nozzle row for the first ink, and a third nozzle row for a first ink, the nozzles in the first to third nozzle rows for the first ink being aligned in a nozzle array direction intersecting the scanning direction; and a first nozzle row for a second ink and a second nozzle row for the second ink, the nozzles in the first and second nozzle rows for the second ink being aligned in the nozzle array direction;

wherein the first nozzle row for the first ink, the second nozzle row for the first ink, and the third nozzle row for the first ink, and the first nozzle row for the second ink and the second nozzle row for the second ink are arranged in the scanning direction;

wherein each of the nozzles in the first nozzle row for the first ink and each of the nozzles in the first nozzle row for the second ink are located at the same position in the nozzle array direction;

wherein each of the nozzles in the second nozzle row for the first ink and each of the nozzles in the second nozzle row for the second ink are located at the same position in the nozzle array direction;

wherein each of the nozzles in the third nozzle row for the first ink is located in a different position in the nozzle array direction with respect to one of the nozzles in the first and second nozzle rows for the first ink;

wherein, in the scanning direction, the first and second nozzle rows for the second ink are arranged between the first and second nozzle rows for the first ink, or the first and second nozzle rows for the first ink are arranged between the first and second nozzle rows for the second ink;

wherein a separation distance in the scanning direction between the first nozzle row for the first ink and the first nozzle row for the second ink is equal to a separation distance in the scanning direction between the second nozzle row for the first ink and the second nozzle row for the second ink;

wherein the channel structure includes a plurality of first common ink chambers and a plurality of second common ink chambers formed therein, the first common ink chambers supplying the first ink to the first to third nozzle rows for the first ink, and the plurality of second common ink chambers supplying the second ink to the first and second nozzle rows for the second ink;

wherein the first nozzle row for the first ink is connected to one of the plurality of first common ink chambers, and the second nozzle row for the first ink is connected to another one of the plurality of first common ink chambers; and wherein the third nozzle row for the first ink is connected to either the one of the first common ink chambers connected to the first nozzle row for the first ink or the another one of the first common ink chambers connected to the second nozzle row for the first ink.

2. The ink jet head according to claim 1;

wherein the first to third nozzle rows for the first ink are arranged between the first and second nozzle rows for the second ink in the scanning direction.

3. The ink jet head according to claim 2;

wherein the third nozzle row for the first ink is arranged between the first and second nozzle rows for the first ink in the scanning direction.

4. An ink jet printer comprising:

the ink jet head as defined in claim 1;

a head drive portion configured to move the ink jet head in the scanning direction; and a controller configured to control the ink jet head and the head drive portion to perform:

jetting the first ink from the first and second nozzle rows for the first ink and jetting the second ink from the first and second nozzle rows for the second ink, while moving the ink jet head to one side in the scanning direction;

jetting the first ink from the first and second nozzle rows for the first ink and jetting the second ink from the first and second nozzle rows for the second ink, while moving the ink jet head to the other side in the scanning direction; and jetting the first ink from the first, second and third nozzle rows for the first ink, while moving the ink jet head in the scanning direction.

5. An ink jet head configured to jet a plurality of types of ink while moving in a scanning direction, the ink jet head comprising:

a channel structure in which ink channels including a plurality of nozzles are formed; and a pressure application mechanism configured to apply a pressure to the ink inside the ink channels;

wherein the channel structure includes:

a first nozzle row for a first ink, a second nozzle row for the first ink, and a third nozzle row for a first ink, the nozzles in the first to third nozzle rows for the first ink being aligned in a nozzle array direction intersecting the scanning direction; and a first nozzle row for a second ink and a second nozzle row for the second ink, the nozzles in the first and second nozzle rows for the second ink being aligned in the nozzle array direction;

wherein the first nozzle row for the first ink, the second nozzle row for the first ink, and the third nozzle row for the first ink, and the first nozzle row for the second ink and the second nozzle row for the second ink are arranged in the scanning direction;

wherein each of the nozzles in the first nozzle row for the first ink and each of the nozzles in the first nozzle row for the second ink are located at the same position in the nozzle array direction;

wherein each of the nozzles in the second nozzle row for the first ink and each of the nozzles in the second nozzle row for the second ink are located at the same position in the nozzle array direction;

wherein each of the nozzles in the third nozzle row for the first ink is located in a different position in the nozzle array direction with respect to one of the nozzles in the first and second nozzle rows for the first ink;

wherein, in the scanning direction, the first and second nozzle rows for the second ink are arranged between the first and second nozzle rows for the first ink, or the first and second nozzle rows for the first ink are arranged between the first and second nozzle rows for the second ink;

wherein a separation distance in the scanning direction between the first nozzle row for the first ink and the first nozzle row for the second ink is equal to a separation distance in the scanning direction between the second nozzle row for the first ink and the second nozzle row for the second ink;

wherein, in each nozzle row of the channel structure, the plurality of nozzles are arrayed at a pitch in the nozzle array direction;

wherein, in the second nozzle row for the first ink, each of the nozzles is shifted in the nozzle array direction by ½ of the pitch with respect to the first nozzle row for the first ink;

wherein, in the second nozzle row for the second ink, each of the nozzles is shifted by ½ of the pitch with respect to the first nozzle row for the second ink;

wherein, in the third nozzle row for the first ink, each nozzle is shifted in the nozzle array direction by ¼ of the pitch with respect to the first nozzle row for the first ink;

wherein the channel structure further includes a fourth nozzle row for the first ink, each nozzle of which is shifted in the position in the nozzle array direction by ½ of the pitch with respect to the third nozzle row for the first ink;

wherein the first nozzle row for the first ink and the second nozzle row for the second ink are arranged on one side of the third nozzle row for the first ink and the fourth nozzle row for the first ink in the scanning direction; and wherein the second nozzle row for the first ink and the first nozzle row for the second ink are arranged on the other side of the third nozzle row for the first ink and the fourth nozzle row for the first ink in the scanning direction.

6. The ink jet head according to claim 5;

wherein the channel structure includes:

a first channel member in which ink channels including the third and fourth nozzle rows for the first ink are formed;

a second channel member which is arranged on one side of the first channel member in the scanning direction, and in which ink channels including the first nozzle row for the first ink and the second nozzle row for the second ink are formed; and a third channel member which is arranged on the other side of the first channel member in the scanning direction, and in which ink channels including the second nozzle row for the first ink and the first nozzle row for the second ink are formed; and wherein the ink channels have an identical channel structure among the first to third channel members.

7. An ink jet head configured to jet a plurality of types of ink while moving in a scanning direction, the ink jet head comprising:

a channel structure in which ink channels including a plurality of nozzles are formed; and a pressure application mechanism configured to apply a pressure to the ink inside the ink channels;

wherein the channel structure includes:

a first nozzle row for a first ink, a second nozzle row for the first ink, and a third nozzle row for a first ink, the nozzles in the first to third nozzle rows for the first ink being aligned in a nozzle array direction intersecting the scanning direction; and a first nozzle row for a second ink and a second nozzle row for the second ink, the nozzles in the first and second nozzle rows for the second ink being aligned in the nozzle array direction;

wherein the first nozzle row for the first ink, the second nozzle row for the first ink, and the third nozzle row for the first ink, and the first nozzle row for the second ink and the second nozzle row for the second ink are arranged in the scanning direction;

wherein each of the nozzles in the first nozzle row for the first ink and each of the nozzles in the first nozzle row for the second ink are located at the same position in the nozzle array direction;

wherein each of the nozzles in the second nozzle row for the first ink and each of the nozzles in the second nozzle row for the second ink are located at the same position in the nozzle array direction;

wherein each of the nozzles in the third nozzle row for the first ink is located in a different position in the nozzle array direction with respect to one of the nozzles in the first and second nozzle rows for the first ink;

wherein, in the scanning direction, the first and second nozzle rows for the first ink are arranged between the first and second nozzle rows for the second ink;

wherein a separation distance in the scanning direction between the first nozzle row for the first ink and the first nozzle row for the second ink is equal to a separation distance in the scanning direction between the second nozzle row for the first ink and the second nozzle row for the second ink; and wherein a number of the nozzles in the first and second nozzle rows for the first ink is larger than a number of the nozzles in the first and second nozzle rows for the second ink.

8. The ink jet head according to claim 7;

wherein the first ink is a black ink.

* * * * *